US008894509B2

(12) United States Patent
Kim et al.

(10) Patent No.: US 8,894,509 B2
(45) Date of Patent: Nov. 25, 2014

(54) GOLF BALL

(75) Inventors: Hyoungchol Kim, Kobe (JP); Masahide Onuki, Kobe (JP); Keiji Moriyama, Kobe (JP); Hirotaka Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 463 days.

(21) Appl. No.: 12/882,377

(22) Filed: Sep. 15, 2010

(65) Prior Publication Data

US 2011/0136590 A1 Jun. 9, 2011

(30) Foreign Application Priority Data

Dec. 8, 2009 (JP) ..... 2009-278132

(51) Int. Cl.
*A63B 37/12* (2006.01)
*A63B 37/00* (2006.01)
*A63B 37/14* (2006.01)

(52) U.S. Cl.
CPC ..... *A63B 37/0004* (2013.01); *A63B 37/0012* (2013.01); *A63B 37/0015* (2013.01); *A63B 37/0017* (2013.01); *A63B 37/002* (2013.01); *A63B 37/0021* (2013.01); *A63B 37/14* (2013.01); *A63B 37/0018* (2013.01); *A63B 37/0019* (2013.01); *A63B 37/0033* (2013.01); *A63B 37/0035* (2013.01); *A63B 37/0051* (2013.01); *A63B 37/0064* (2013.01); *A63B 37/008* (2013.01); *A63B 37/0083* (2013.01)
USPC ..... 473/373

(58) Field of Classification Search
USPC ..... 473/383–384
See application file for complete search history.

(56) References Cited

U.S. PATENT DOCUMENTS

| | | | | |
|---|---|---|---|---|
| 4,681,323 | A | 7/1987 | Alaki et al. | |
| 4,787,638 | A * | 11/1988 | Kobayashi | 473/383 |
| 5,720,676 | A | 2/1998 | Shimosaka et al. | |
| 5,980,232 | A | 11/1999 | Shimosaka et al. | |
| 6,039,660 | A | 3/2000 | Kasashima et al. | |
| 6,176,793 | B1 | 1/2001 | Sullivan et al. | |
| 6,315,686 | B1 * | 11/2001 | Barfield | 473/383 |
| 6,632,150 | B1 | 10/2003 | Ogg | |
| 7,250,012 | B1 | 7/2007 | Simonds et al. | |

(Continued)

FOREIGN PATENT DOCUMENTS

| | | | |
|---|---|---|---|
| JP | 60-163674 | A | 8/1985 |
| JP | 06-190082 | A | 7/1994 |

(Continued)

*Primary Examiner* — Raeann Gorden
(74) *Attorney, Agent, or Firm* — Birch, Stewart, Kolasch & Birch, LLP

(57) ABSTRACT

A cross-sectional shape of each of dimples 8 of a golf ball 2 is a wave-like curve. The wave-like curve has two first curves 14, two second curves 16, two third curves 18, and one fourth curve 20. Each first curve 14 and each third curve 18 are upwardly convex. Each second curve 16 and the fourth curve 20 are downwardly convex. Each first curve 14 is connoted to a land 10 at an edge Ed. Each second curve 16 is connected to the first curve 14 at a first inflexion point 22. Each third curve 18 is connected to the second curve 16 at a second inflexion point 24. The fourth curve 20 is connected to the third curves 18 at third inflexion points 26. In the wave-like curve, the upwardly convex curves 14 and 18 and the downwardly convex curves 16 and 20 are alternately arranged.

4 Claims, 11 Drawing Sheets

(56) References Cited

U.S. PATENT DOCUMENTS

| | | | | |
|---|---|---|---|---|
| 7,503,857 | B2 | 3/2009 | Kasashima et al. | |
| 7,601,080 | B2 * | 10/2009 | Olson et al. | 473/384 |
| 8,337,334 | B2 * | 12/2012 | Goodwin | 473/384 |
| 2001/0036872 | A1 | 11/2001 | Kasashima et al. | |
| 2003/0114255 | A1 | 6/2003 | Dalton et al. | |
| 2004/0132551 | A1 | 7/2004 | Aoyama et al. | |
| 2006/0116220 | A1 | 6/2006 | Ohama et al. | |
| 2007/0259738 | A1 | 11/2007 | Sato et al. | |
| 2011/0195802 | A1 * | 8/2011 | Nakamura et al. | 473/384 |

FOREIGN PATENT DOCUMENTS

| | | | |
|---|---|---|---|
| JP | 9-094309 | A | 4/1997 |
| JP | 11-057065 | A | 3/1999 |
| JP | 2001-276277 | A | 10/2001 |
| JP | 2002-537914 | A | 11/2002 |
| JP | 2003-154031 | A | 5/2003 |
| JP | 2004-195226 | A | 7/2004 |
| JP | 2004-209258 | A | 7/2004 |
| JP | 2006-149937 | A | 6/2006 |
| JP | 2007-301359 | A | 11/2007 |

* cited by examiner

GOLF BALL

This application claims priority on patent application Ser. No. 2009-278132 filed in JAPAN on Dec. 8, 2009. The entire contents of this Japanese Patent Application are hereby incorporated by reference.

BACKGROUND OF THE INVENTION

1. Field of the Invention

The present invention relates to golf balls. Specifically, the present invention relates to improvement of dimples of golf balls.

2. Description of the Related Art

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the airflow. The excellent dimples produce a long flight distance.

There have been various proposals for the shapes of dimples. U.S. Pat. No. 7,250,012 discloses a golf ball that has dimples each having a annular tubular portion. U.S. Pat. No. 7,503,857 discloses a golf ball that has dimples each having formed therein a raised region.

The greatest interest to golf players concerning golf balls is flight distance. In light of flight performance, there is room for improvement in the shapes of dimples. An object of the present invention is to provide a golf ball having excellent flight performance.

SUMMARY OF THE INVENTION

A golf ball according to the present invention has a large number of dimples on a surface thereof. Each dimple has a curved surface. A cross-sectional shape of the curved surface is a wave-like curve in which a plurality of upwardly convex portions and a plurality of downwardly convex portions are alternately arranged.

The golf ball according to the present invention has excellent flight performance. The detailed reason has not been identified, but it is inferred that this is because separation of air from the dimple surface in the dimple is prevented and separated air re-contacts the dimple surface in the dimple.

Preferably, the number of the upwardly convex portions included in the wave-like curve is equal to or greater than 2 but equal to or less than 7.

Preferably, the wave-like curve is obtained by a sine curve and a circular arc being combined with each other. Preferably, the number of cycles of the wave-like curve is equal to or greater than 1.5 but equal to or less than 5.5.

The wave-like curve may be obtained by a cosine curve and a circular arc being combined with each other. Preferably, the number of cycles of the wave-like curve is equal to or greater than 2.0 but equal to or less than 6.0.

Preferably, a diameter of each dimple is equal to or greater than 2.0 mm but equal to or less than 6.0 mm. Preferably, a ratio of a sum of areas of all the dimples to a surface area of a phantom sphere is equal to or greater than 70% but equal to or less than 90%. Preferably, a total volume of the dimples is equal to or greater than 250 $mm^3$ but equal to or less than 400 $mm^3$.

The golf ball may have: the dimples each having a curved surface whose cross-sectional shape is the wave-like curve; and other dimples. Preferably, a ratio (N1/N) of the number N1 of the dimples each having a curved surface whose cross-sectional shape is the wave-like curve, to the total number N of the dimples, is equal to or greater than 0.3.

A method for designing a shape of a dimple according to the present invention comprises the steps of:

assuming a first curved line on an X-Y plane;

assuming, on the X-Y plane, a second curved line having one end and another end, an x coordinate of the one end agreeing with an x coordinate of one end of the first curved line, and an x coordinate of the other end agreeing with an x coordinate of another end of the first curved line;

obtaining a wave-like curve by adding or subtracting, to or from a y coordinate of each point on the first curved line, a y coordinate of a point, on the second curved line, which has the same x coordinate as an x coordinate of this point; and obtaining a three-dimensional shape by rotating the wave-like curve 180 degrees about a straight line that intersects the wave-like curve at a central point of the wave-like curve.

Preferably, the first curved line is a circular arc, and the second curved line is a sine curve or a cosine curve. Preferably, an amplitude of the sine curve or the cosine curve is equal to or greater than 5% of a depth of the circular arc but equal to or less than 50% of the depth of the circular arc.

Preferably, the second curved line is a sine curve. A ratio of a wavelength of the sine curve to a length of a chord corresponding to the circular arc, is equal to or greater than (1/5.5) but equal to or less than (1/1.5).

The second curved line may be a cosine curve. Preferably, a ratio of a wavelength of the cosine curve to a length of a chord corresponding to the circular arc, is equal to or greater than (1/6) but equal to or less than (1/2).

DESCRIPTION OF THE PREFERRED EMBODIMENTS

The following will describe in detail the present invention based on preferred embodiments with reference to the accompanying drawings.

Figure 1:
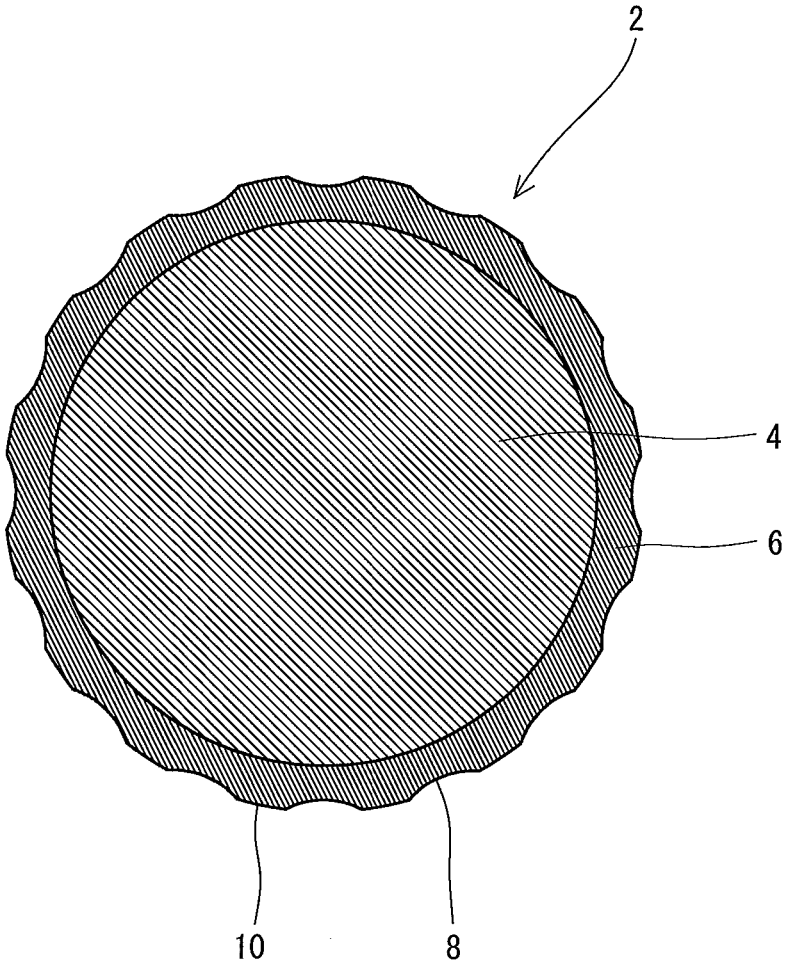
FIG. 1 is a cross-sectional view of a golf ball according to an embodiment of the present invention.
Figure 2:
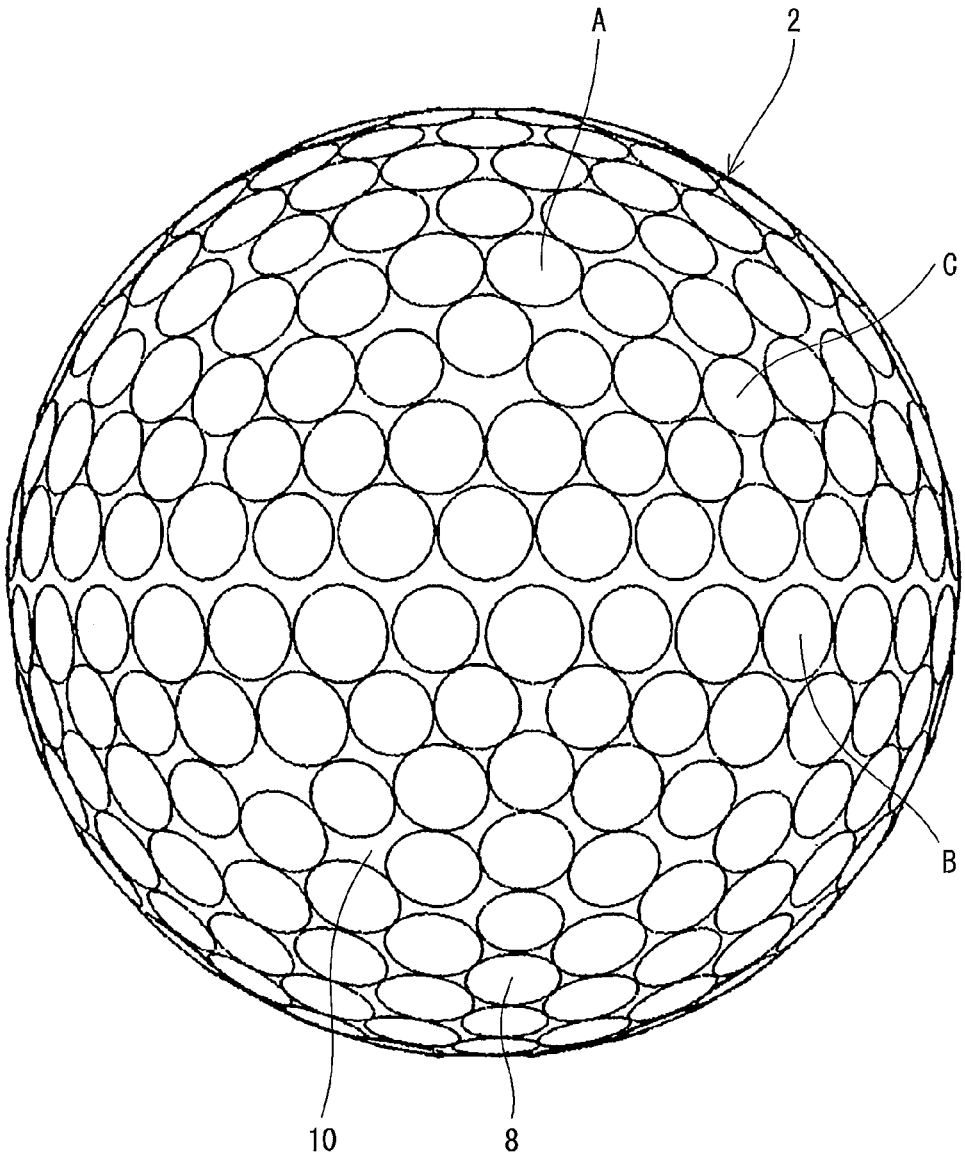
FIG. 2 is an enlarged front view of the golf ball in FIG. 1.
Figure 3:
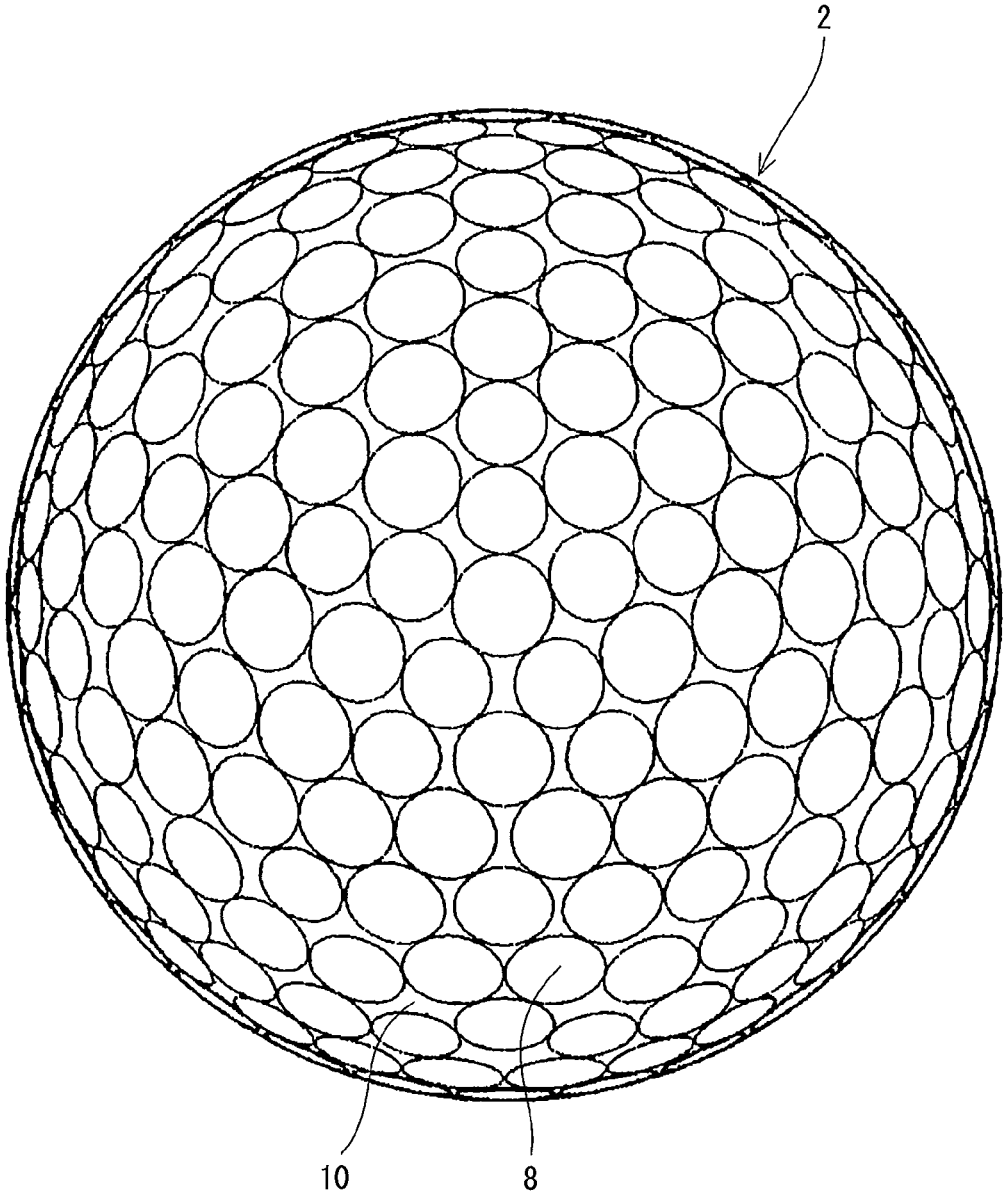
FIG. 3 is a plan view of the golf ball in FIG. 2.

A golf ball 2 shown in FIGS. 1 to 3 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 has a diameter of 40 mm or greater and 45 mm or less. From the standpoint of conformity to the rules established by the United States Golf Association (USGA), the diameter is more preferably equal to or greater than 42.67 mm. In light of suppression of air resistance, the diameter is more preferably equal to or less than 44 mm and particularly preferably equal to or less than 42.80 mm. The golf ball 2 has a weight of 40 g or greater and 50 g or less. In light of attainment of great inertia, the weight is more preferably equal to or greater than 44 g and particularly preferably equal to or greater than 45.00 g. From the standpoint of conformity to the rules established by the USGA, the weight is more preferably equal to or less than 45.93 g.

The core 4 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more types of these rubbers may be used in combination. In light of resilience performance, polybutadienes are preferred, and in particular, high-cis polybutadienes are preferred.

In order to crosslink the core 4, a co-crosslinking agent is suitably used. Examples of preferable co-crosslinking agents in light of resilience performance include zinc acrylate, magnesium acrylate, zinc methacrylate and magnesium methacrylate. Preferably, the rubber composition includes an organic peroxide together with a co-crosslinking agent. Examples of suitable organic peroxides include dicumyl peroxide, 1,1-bis(t-butylperoxy)-3,3,5-trimethylcyclohexane, 2,5-dimethyl-2,5-di (t-butylperoxy) hexane and di-t-butyl peroxide.

According to need, various additives such as a filler, sulfur, a vulcanization accelerator, a sulfur compound, an anti-aging agent, a coloring agent, a plasticizer, a dispersant and the like are included in the rubber composition for the core 4 in an adequate amount. Crosslinked rubber powder or synthetic resin powder may be also included in the rubber composition. The core 4 has a diameter of 30.0 mm or greater and particularly 38.0 mm or greater. The diameter of the core 4 is equal to or less than 42.0 mm and particularly equal to or less than 41.5 mm. The core 4 may be formed with two or more layers. The core 4 may have a rib on the surface thereof. The core 4 may be hollow.

A suitable polymer for the cover 6 is an ionomer resin. Examples of preferable ionomer resins include binary copolymers formed with an a-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion and neodymium ion.

Another polymer may be used for the cover 6 instead of an ionomer resin. Examples of the other polymer include polyurethanes, polystyrenes, polyamides, polyesters and polyolefins. In light of spin performance and scuff resistance, polyurethanes are preferred. Two or more types of these polymers may be used in combination.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the cover 6 at an adequate amount. For the purpose of adjusting specific gravity, powder of a metal with a high specific gravity such as tungsten, molybdenum and the like may be included in the cover 6.

The cover 6 has a thickness of 0.2 mm or greater and particularly 0.3 mm or greater. The thickness of the cover 6 is equal to or less than 2.5 mm and particularly equal to or less than 2.2 mm. The cover 6 has a specific gravity of 0.90 or greater and particularly 0.95 or greater. The specific gravity of the cover 6 is equal to or less than 1.10 and particularly equal to or less than 1.05. The cover 6 may be formed with two or more layers.

As shown in FIGS. 2 and 3, the contour of the dimple 8 is circular. The golf ball 2 has dimples A each having a diameter of 4.46 mm, dimples B each having a diameter of 4.36 mm, and dimples C each having a diameter of 3.9 mm. The number of types of the dimples 8 is three. The number of the types may be one, two, or four or more. The number of the dimples A is 112, the number of the dimples B is 100, and the number of the dimples C is 120. The total number of the dimples 8 is 332.

Figure 4:
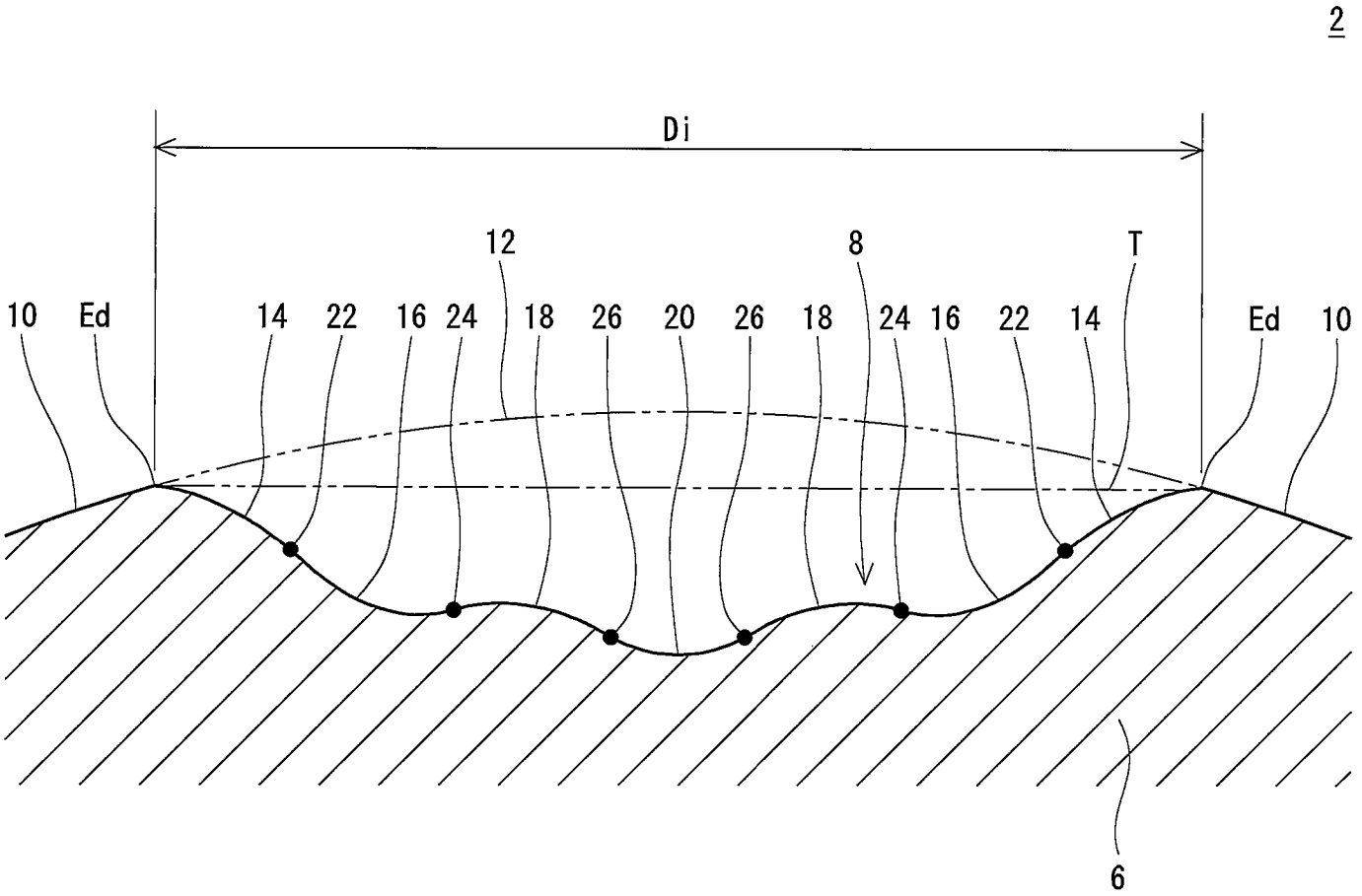
FIG. 4 is an enlarged cross-sectional view of a dimple of the golf ball in FIG. 1.

FIG. 4 shows a cross section along a plane passing through the center of the dimple 8 and the center of the golf ball 2. The dimple 8 has a curved surface. In FIG. 4, the top-to-bottom direction is the depth direction of the dimple 8. In FIG. 4, what is indicated by a chain double-dashed line 12 is the surface of a phantom sphere. The surface of the phantom sphere 12 is the surface of the golf ball 2 when it is postulated that no dimple 8 exists. The dimple 8 is recessed from the surface of the phantom sphere 12. The land 10 agrees with the surface of the phantom sphere 12.

In FIG. 4, what is indicated by a double ended arrow Di is the diameter of the dimple 8. The diameter Di is the distance between two tangent points Ed appearing on a tangent line T that is drawn tangent to the far opposite ends of the dimple 8. Each tangent point Ed is also the edge of the dimple 8. The edge Ed defines the contour of the dimple 8. The diameter Di is preferably equal to or greater than 2.0 mm but equal to or less than 6.0 mm. By setting the diameter Di to be 2.0 mm or greater, a superior dimple effect is achieved. In this respect, the diameter Di is more preferably equal to or greater than 2.50 mm and particularly preferably equal to or greater than 3.0 mm. By setting the diameter Di to be 6.0 mm or less, a fundamental feature of the golf ball 2 being substantially a sphere is not impaired. In this respect, the diameter Di is more preferably equal to or less than 5.5 mm and particularly preferably equal to or less than 5.0 mm.

As shown in FIG. 4, a cross-sectional shape of the dimple 8 is a wave-like curve. The wave-like curve extends from one edge Ed to another edge Ed. The wave-like curve has two first curves 14, two second curves 16, two third curves 18, and one fourth curve 20. Each first curve 14 is upwardly convex. Each second curve 16 is downwardly convex. Each third curve 18 is upwardly convex. The fourth curve 20 is downwardly convex. Each first curve 14 is connected to the land 10 at the edge Ed. Each second curve 16 is connected to the first curve 14 at a first inflexion point 22. Each third curve 18 is connected to the second curve 16 at a second inflexion point 24. The fourth curve 20 is connected to the third curves 18 at third inflexion points 26. In the wave-like curve, a plurality of the upwardly convex curves 14 and 18 and a plurality of the downwardly convex curves 16 and 20 are alternately arranged.

Figure 5:
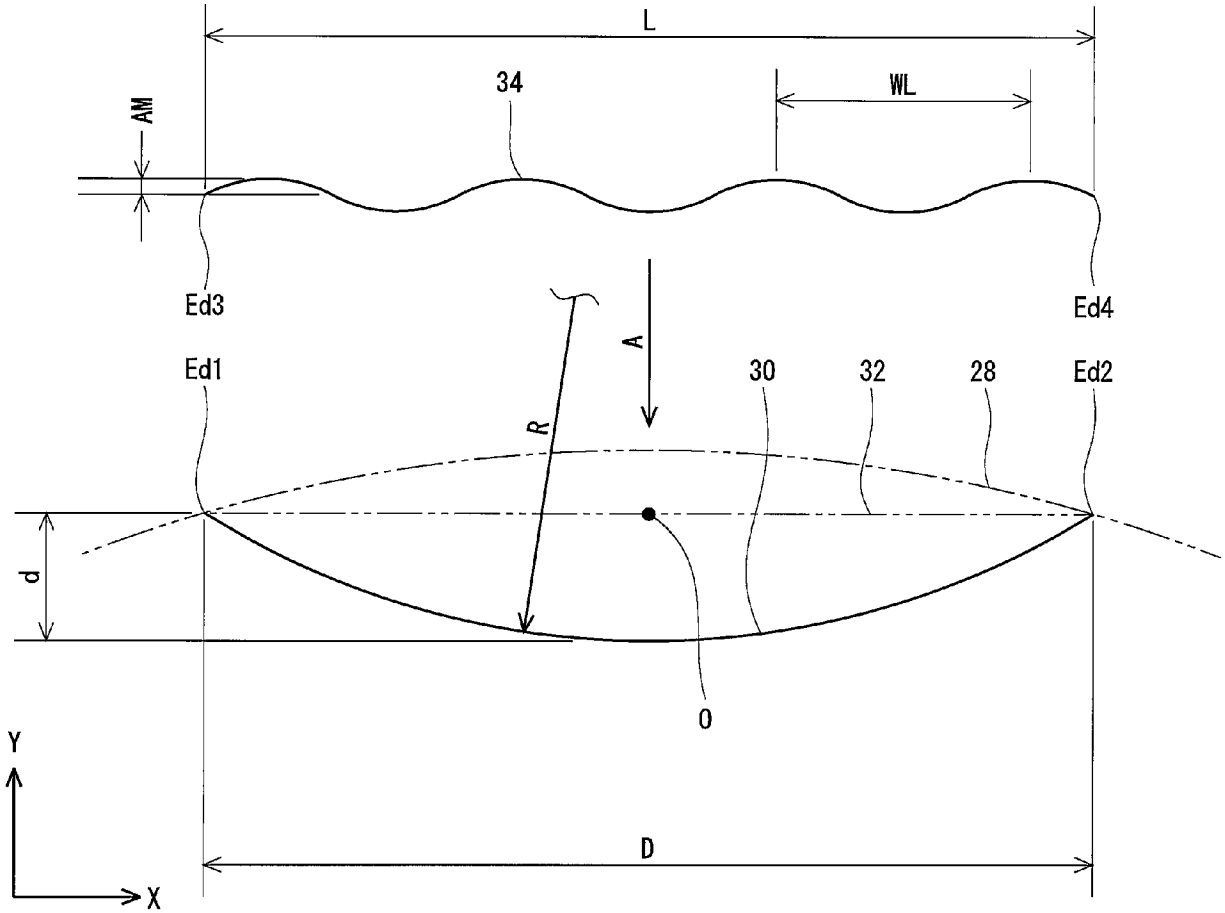
FIG. 5 is a view for illustrating a method for designing the dimple in FIG. 4.

In a method for designing the dimple 8, a circle 28 is assumed on an X-Y plane indicated in FIG. 5. The radius of the circle 28 is the same as the radius of the phantom sphere 12 (see FIG. 4) of the golf ball 2. Further, on the X-Y plane, a circular arc 30 (first curved line) is assumed. The circular arc 30 has one end Edi and another end Ed2 that are present on the circle 28. The circular arc 30 is downwardly convex. In FIG. 5, what is indicated by an arrow D is the length of a chord 32 corresponding to the circular arc 30. The coordinate of an origin O of the X-Y plane is (0,0). The origin O is the midpoint of the chord 32. The y coordinate of a point on the circular arc 30 is represented by the following mathematical formula (1).

$$y=(R-d)-\sqrt{(R^2-x^2)} \quad (1)$$

In the mathematical formula (1), R denotes the curvature radius of the circular arc 30, and d denotes the depth of the circular arc 30.

As shown in FIG. 5, a sine curve 34 (second curved line) is assumed on the X-Y plane. The sine curve 34 is bilaterally symmetrical. The sine curve 34 has one end Ed3 and another end Ed4. In FIG. 5, what is indicated by an arrow L is the length of the sine curve 34; what is indicated by an arrow WL is the wavelength of the sine curve 34; and what is indicated by an arrow AM is the amplitude of the sine curve 34. The length L of the sine curve 34 is the same as the length D of the chord 32. The number of cycles of the sine curve 34 is 3.5. The sine curve 34 is moved in the direction indicated by an arrow A. As a result of the movement, the end Ed3 of the sine curve 34 agrees with the end Edi of the circular arc 30, and the other end Ed4 of the sine curve 34 agrees with the other end Ed2 of the circular arc 30.

Figure 6:
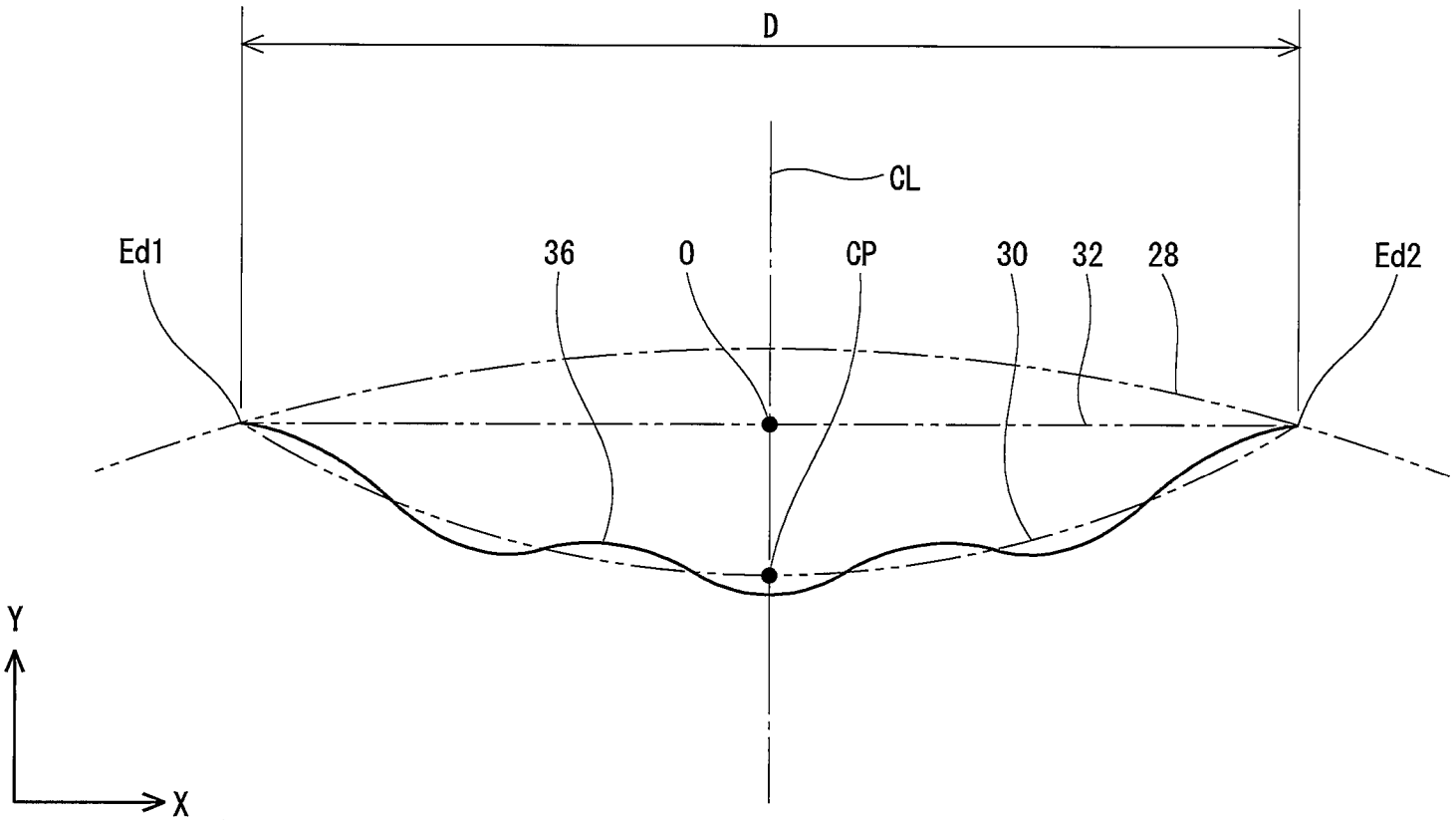
FIG. 6 is a view for illustrating the method for designing the dimple in FIG. 4.

The circular arc 30 and the sine curve 34 are combined with each other. Specifically, to the y coordinate of each point on the circular arc 30, the y coordinate of a point, on the sine curve 34, which has the same x coordinate as the x coordinate of this point, is added. As a result of the addition, a wave-like curve 36 is obtained. The wave-like curve 36 is shown in FIG. 6. The y coordinate of the wave-like curve 36 is represented by the following mathematical formula (2).

$$y=(R-d)-\sqrt{(R^2-x^2)}+d\times Q\times\sin\left\{\left[\frac{\sin^{-1}\left(\frac{D}{2R}\right)+\sin^{-1}\left(\frac{x}{R}\right)}{\sin^{-1}\left(\frac{D}{2R}\right)}\right]\times\frac{S\times\pi}{180}\right\} \quad (2)$$

In the mathematical formula (2), Q denotes an amplitude adjustment coefficient, and S denotes an adjustment coefficient of the number of cycles. The coefficient Q is set as appropriate by taking into consideration a balance of the amplitude AM of the sine curve 34 relative to the depth d of the circular arc 30. The coefficient S is set such that the desired number of cycles of the sine curve 34 is achieved. When S is 270, the number of cycles is 1.5. When S is 450, the number of cycles is 2.5. When S is 630, the number of cycles is 3.5. When S is 810, the number of cycles is 4.5. When S is 990, the number of cycles is 5.5. In the sine curve 34 shown in FIG. 5, S is 630. Thus, the number of cycles of the sine curve 34 is 3.5.

In FIG. 6, what is indicated by a reference sign CL is a straight line passing through the central point CP of the circular arc 30 and the origin O. The wave-like curve 36 is rotated 180 degrees about the straight line CL. On the basis of a trajectory through which the wave-like curve 36 passes by the rotation, a three-dimensional shape is obtained. The dimple 8 shown in FIG. 4 has this three-dimensional shape. The diameter Di of the dimple 8 is the same as the length D of the chord 32.

In general, when a golf ball flies, eddies of air occur around the golf ball. According to the finding by the inventor of the present invention using a simulation, the size of each eddy is about ⅛ of an average diameter of a dimple. In other words, the diameter of the dimple is sufficiently larger than the size of each eddy. Thus, the wave-like curve 36 shown in FIG. 6 can cause local turbulence of air inside the dimple 8. The wave-like curve 36 is inferred to contribute to backward shift of separation points. The wave-like curve 36 is also inferred to contribute to re-contact of separated eddies. The golf ball 2 has excellent flight performance.

The number of cycles of the wave-like curve 36 obtained by combining the circular arc 30 and the sine curve 34, is the same as the number of cycles of the sine curve 34. As described above, the number of cycles of the sine curve 34 shown in FIG. 5 is 3.5. Thus, the number of cycles of the wave-like curve 36 shown in FIG. 6 is 3.5. In light of flight performance, the number of cycles of the wave-like curve 36 is preferably equal to or greater than 1.5 but equal to or less than 5.5. By the wave-like curve 36 symmetrical about the straight line CL being rotated, the dimple 8 can be formed so as not to have directional properties. The dimple 8 that does not have directional properties has excellent aerodynamic symmetry. In light of aerodynamic symmetry, the number of cycles of the wave-like curve 36 obtained by combining the circular arc 30 and the sine curve 34, is preferably "n+0.5 (n is a natural number)". Examples of the preferable number of cycles include 1.5, 2.5, 3.5, 4.5 and 5.5. 2.5, 3.5 and 4.5 are more preferred, and 3.5 is particularly preferred.

In light of flight performance, the ratio of the amplitude AM of the sine curve 34 to the depth d of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly preferably equal to or less than 20%.

In light of flight performance, the ratio (WL/D) of the wavelength WL of the sine curve 34 to the length D of the chord 32 is preferably equal to or greater than (1/5.5) but equal to or less than (1/1.5). The ratio (WL/D) is more preferably equal to or greater than (1/4.5). The ratio (WL/D) is more preferably equal to or less than (1/2.5). The ratio (WL/D) is particularly preferably (1/3.5).

The golf ball 2 may have: dimples 8 each having a curved surface whose cross-sectional shape is the wave-like curve 36; and other dimples. The ratio (N1/N) of the number N1 of the dimples 8 each having a curved surface whose cross-sectional shape is the wave-like curve 36, to the total number N of the dimples, is preferably equal to or greater than 0.3, more preferably equal to or greater than 0.5, and particularly preferably equal to or greater than 0.7. Ideally, the ratio (N1/N) is 1.0.

In light of suppression of rising of the golf ball 2 during flight, the depth d of the circular arc 30 is preferably equal to or greater than 0.05 mm, more preferably equal to or greater than 0.08 mm, and particularly preferably equal to or greater than 0.10 mm. In light of suppression of dropping of the golf ball 2 during flight, the depth d is preferably equal to or less than 0.60 mm, more preferably equal to or less than 0.45 mm, and particularly preferably equal to or less than 0.40 mm.

The area s of the dimple 8 is the area of a region surrounded by the contour line when the center of the golf ball 2 is viewed at infinity. In the case of a circular dimple, the area s is calculated by the following mathematical formula.

$$s=(Di/2)^2*n$$

In the golf ball 2 shown in FIGS. 1 to 6, the area of the dimple A is 15.62 $mm^2$; the area of the dimple B is 14.93 $mm^2$; and the area of the dimple C is 11.95 $mm^2$.

In the present invention, the ratio of the sum of the areas s of all the dimples 8 to the surface area of the phantom sphere 12 is referred to as an occupation ratio. From the standpoint that a sufficient dimple effect is achieved, the occupation ratio is preferably equal to or greater than 70%, more preferably equal to or greater than 78%, and particularly preferably equal to or greater than 80%. The occupation ratio is preferably equal to or less than 90%. In the golf ball 2 shown in FIGS. 1 to 6, the total area of all the dimples 8 is 4676.4 $mm^2$. The surface area of the phantom sphere 12 of the golf ball 2 is 4629 $mm^2$, and thus the occupation ratio is 81.6%.

In the present invention, the term "dimple volume" means the volume of a part surrounded by the surface of the dimple 8 and a plane that includes the contour of the dimple 8. In light of suppression of rising of the golf ball 2 during flight, the total volume of all the dimples 8 is preferably equal to or greater than 250 $mm^3$, more preferably equal to or greater than 260 $mm^3$, and particularly preferably equal to or greater than 270 $mm^3$. In light of suppression of dropping of the golf ball 2 during flight, the total volume is preferably equal to or less than 400 $mm^3$, more preferably equal to or less than 390 $mm^3$, and particularly preferably equal to or less than 380 $mm^3$.

As a first curved line, a double radius curve, a triple radius curve, or the like may be used. As a second curved line, various curves each having a cycle can be used. Even when either curve is used, the number of the upwardly convex portions included in the wave-like curve is preferably equal to or greater than 2 but equal to or less than 7.

Figure 7:
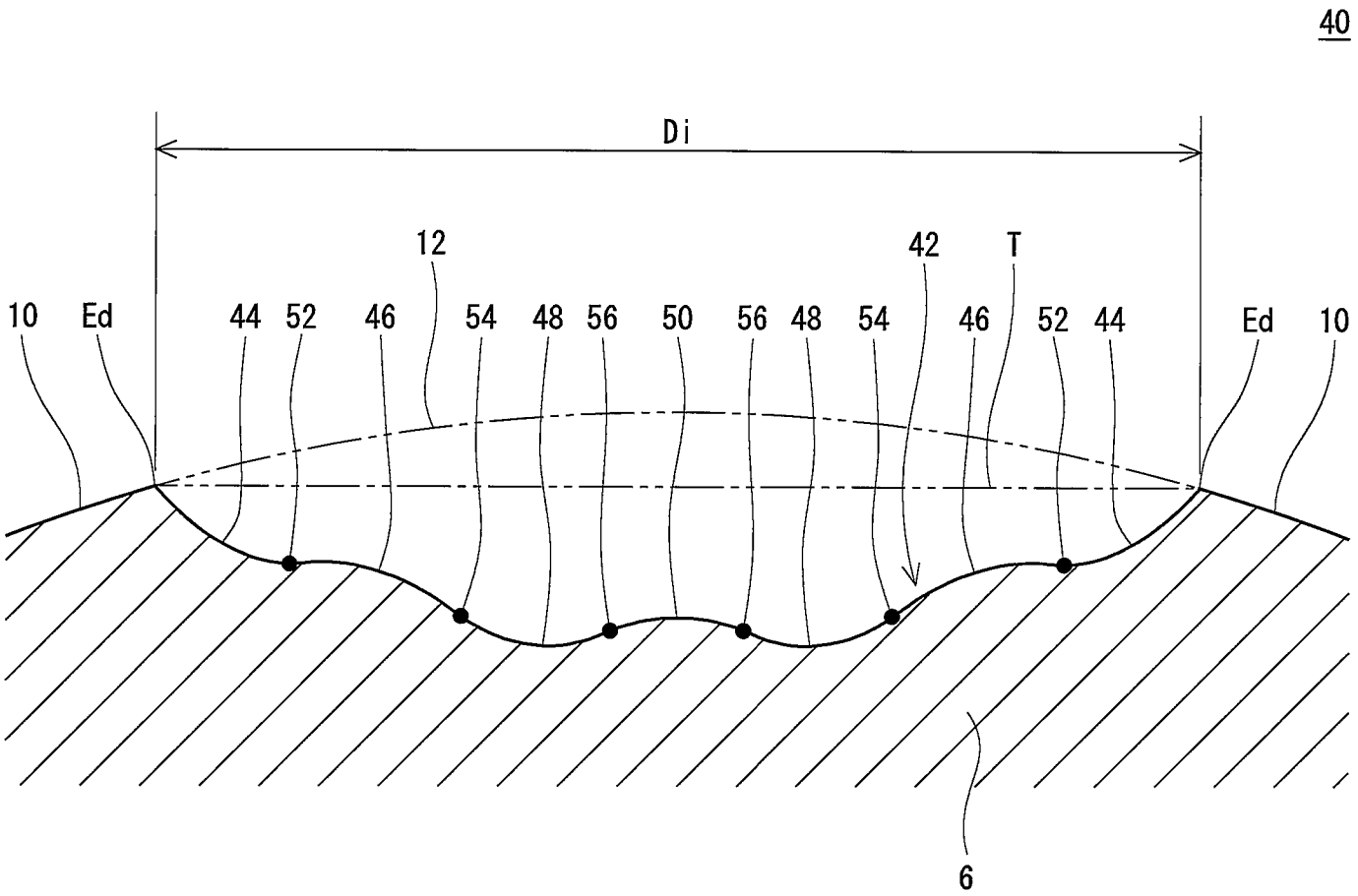
FIG. 7 is a cross-sectional view of a dimple of a golf ball according to another embodiment of the present invention.

FIG. 7 is a cross-sectional view of a dimple 42 of a golf ball 40 according to another embodiment of the present invention. The structure of a part of the golf ball 40 other than the dimple 42 is the same as that of the golf ball 2 shown in FIG. 1. FIG. 7 shows a cross section along a plane passing through the center of the dimple 42 and the center of the golf ball 40. The dimple 42 has a curved surface. The diameter Di of the dimple 42 is preferably equal to or greater than 2.0 mm but equal to or less than 6.0 mm. The diameter Di is more preferably equal to or greater than 2.50 mm and particularly preferably equal to or greater than 3.0 mm. The diameter Di is more preferably equal to or less than 5.5 mm and particularly preferably equal to or less than 5.0 mm.

As shown in FIG. 7, a cross-sectional shape of the dimple 42 is a wave-like curve. The wave-like curve extends from one edge Ed to another edge Ed. The wave-like curve has two first curves 44, two second curves 46, two third curves 48, and one fourth curve 50. Each first curve 44 is downwardly convex. Each second curve 46 is upwardly convex. Each third curve 48 is downwardly convex. The fourth curve 50 is upwardly convex. Each first curve 44 is connected to the land 10 at the edge Ed. Each second curve 46 is connected to the first curve 44 at a first inflexion point 52. Each third curve 48 is connected to the second curve 46 at a second inflexion point 54. The fourth curve 50 is connected to the third curves 48 at third inflexion points 56. In the wave-like curve, a plurality of the upwardly convex curves 46 and 50 and a plurality of the downwardly convex curves 44 and 48 are alternately arranged.

Figure 8:
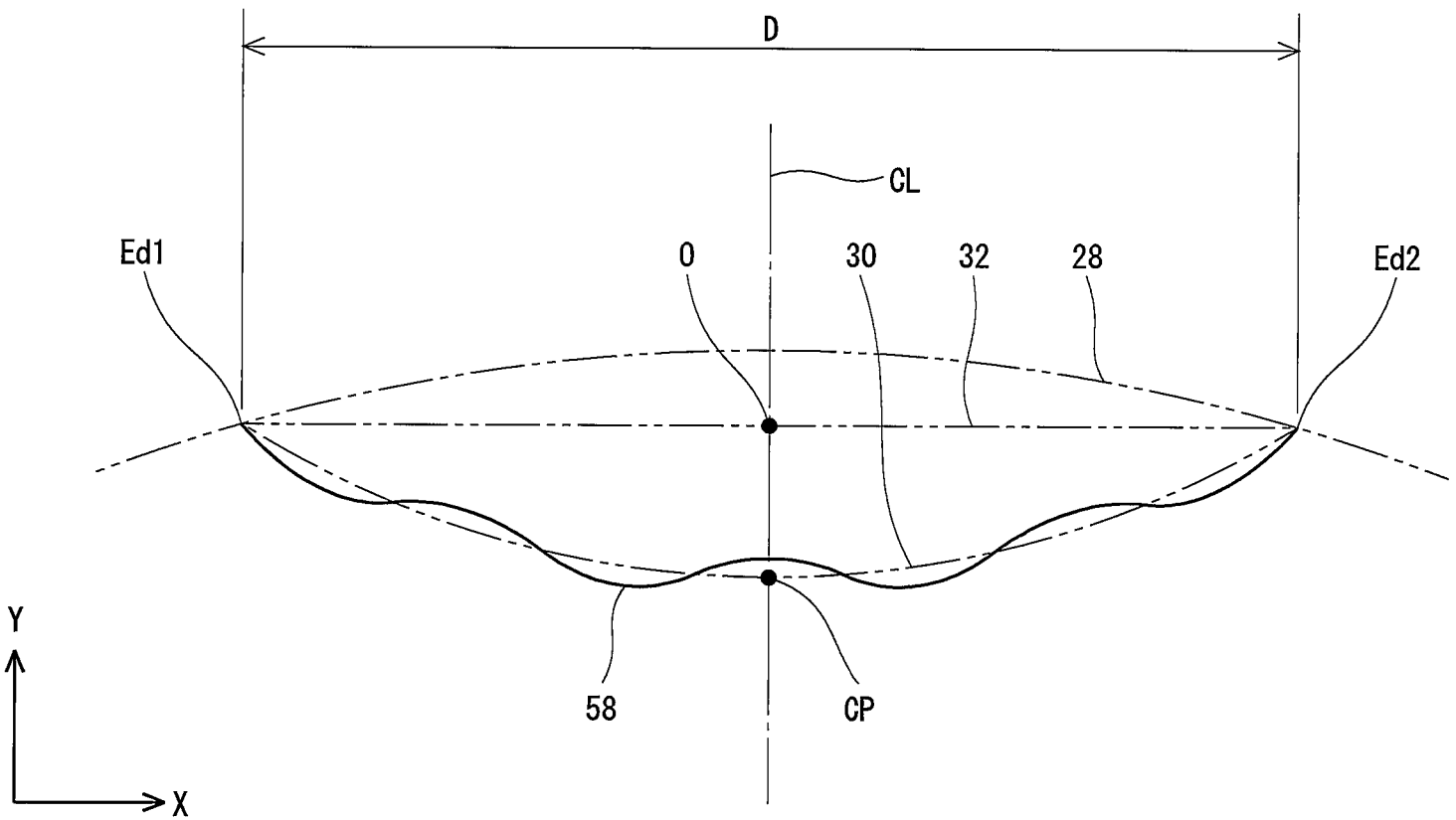
FIG. 8 is a view for illustrating a method for designing the dimple in FIG. 7.

In a method for designing the dimple 42, the same circle 28, circular arc 30 (first curved line), and sine curve 34 (second curved line) are assumed as in the method for designing the dimple 2 shown in FIGS. 4 to 6. In designing the dimple 2 shown in FIGS. 4 to 6, when the circular arc 30 and the sine curve 34 are combined with each other, the y coordinate of the sine curve 34 is added to the y coordinate of the circular arc 30. In designing the dimple 42 shown in FIG. 7, when the circular arc 30 and the sine curve 34 are combined with each other, the y coordinate of the sine curve 34 is subtracted from the y coordinate of the circular arc 30 . A wave-like curve 58 obtained by the subtraction is shown in FIG. 8. The y coordinate of the wave-like curve 58 is represented by the following mathematical formula (3).

$$y=(R-d)-\sqrt{(R^2-x^2)}-d\times Q\times\sin\left\{\left[\frac{\sin^{-1}\left(\frac{D}{2R}\right)+\sin^{-1}\left(\frac{x}{R}\right)}{\sin^{-1}\left(\frac{D}{2R}\right)}\right]\times\frac{S\times\pi}{180}\right\} \quad (3)$$

The wave-like curve 58 is rotated 180 degrees about a straight line CL. As a result of the rotation, a three-dimensional shape is obtained. The dimple 42 shown in FIG. 7 has this three-dimensional shape. The diameter Di of the dimple 42 is the same as the length D of a chord.

In the golf ball 40 as well, the wave-like curve 58 can cause local turbulence of air inside the dimple 42. The wave-like curve 58 is inferred to contribute to backward shift of separation points. The wave-like curve 58 is also inferred to contribute to re-contact of separated eddies. The golf ball 40 has excellent flight performance.

The number of cycles of the wave-like curve 58 obtained by combining the circular arc 30 and the sine curve 34, is the same as the number of cycles of the sine curve 34. As described above, the number of cycles of the sine curve 34 shown in FIG. 5 is 3.5. Thus, the number of cycles of the wave-like curve 58 shown in FIG. 8 is 3.5. In light of flight performance, the number of cycles of the wave-like curve 58 is preferably equal to or greater than 1.5 but equal to or less than 5.5.

By the wave-like curve 58 symmetrical about the straight line CL being rotated, the dimple 42 can be formed so as not to have directional properties. The dimple 42 that does not have directional properties has excellent aerodynamic symmetry.

In light of aerodynamic symmetry, the number of cycles of the wave-like curve 58 obtained by combining the circular arc 30 and the sine curve 34, is preferably "n+0.5 (n is a natural number)". Examples of the preferable number of cycles include 1.5, 2.5, 3.5, 4.5 and 5.5. 2.5, 3.5 and 4.5 are more preferred, and 3.5 is particularly preferred.

In light of flight performance, the ratio of the amplitude AM to the depth d (see FIG. 5) of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly preferably equal to or less than 20%.

In light of flight performance, the ratio (WL/D) of the wavelength WL of the sine curve 34 to the length D of the chord is preferably equal to or greater than (1/5.5) but equal to or less than (1/1.5). The ratio (WL/D) is more preferably equal to or greater than (1/4.5). The ratio (WL/D) is more preferably equal to or less than (1/2.5). The ratio (WL/D) is particularly preferably (1/3.5).

The golf ball 40 may have: dimples 42 each having a curved surface whose cross-sectional shape is the wave-like curve 58; and other dimples. The ratio (N1/N) of the number N1 of the dimples 42 each having a curved surface whose cross-sectional shape is the wave-like curve 58, to the total number N of the dimples, is preferably equal to or greater than 0.3, more preferably equal to or greater than 0.5, and particularly preferably equal to or greater than 0.7. Ideally, the ratio (N1/N) is 1.0.

Figure 9:
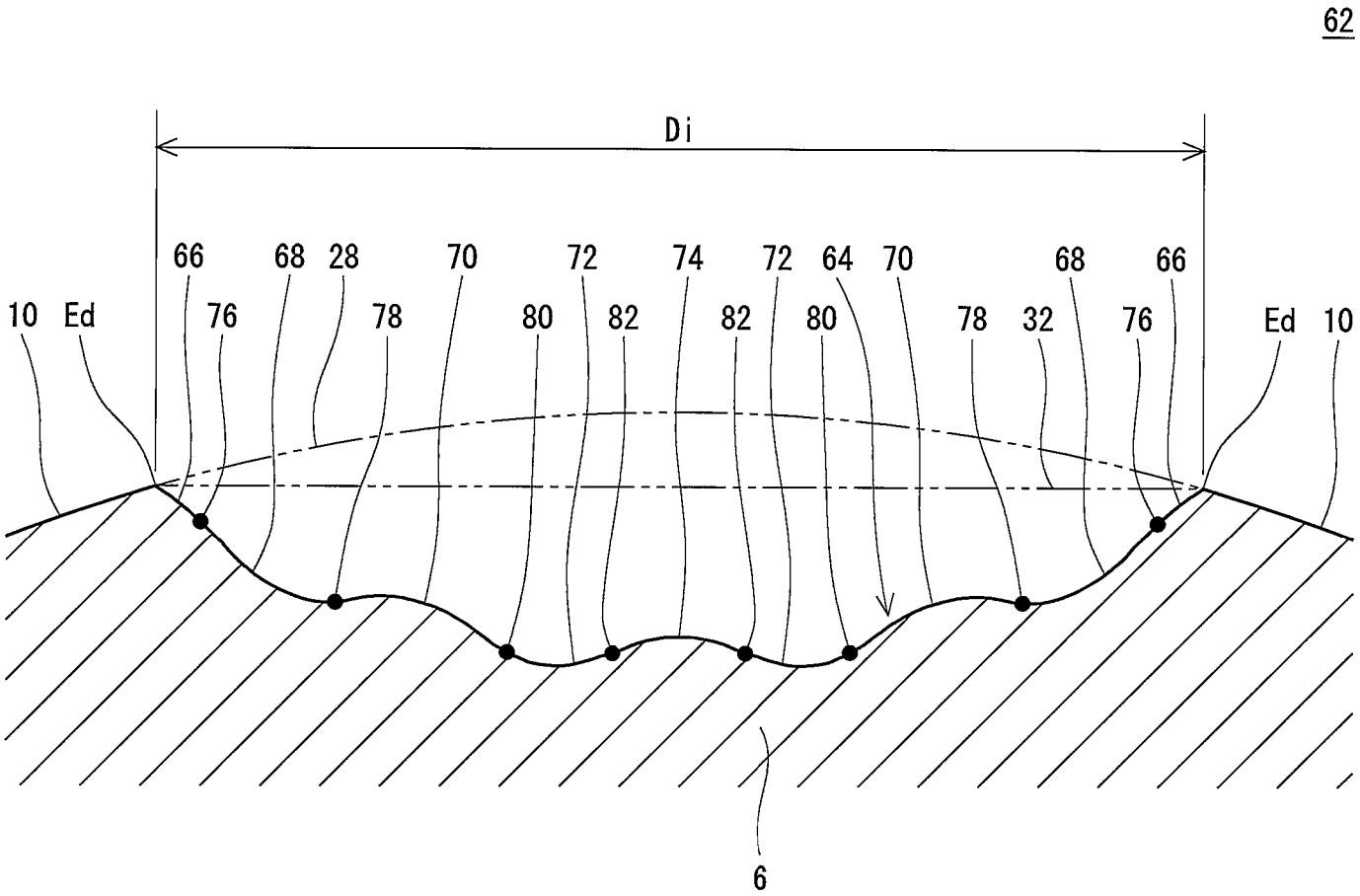
FIG. 9 is a cross-sectional view of a dimple of a golf ball according to still another embodiment of the present invention.

The depth d of the circular arc 30, the occupation ratio, and the total volume of the dimples, of the golf ball 40 are the same as those of the golf ball 2 shown in FIGS. 1 to 6. FIG. 9 is a cross-sectional view of a dimple 64 of a golf ball 62 according to still another embodiment of the present invention. The structure of a part of the golf ball 62 other than the dimple 64 is the same as that of the golf ball 2 shown in FIG. 1. FIG. 9 shows a cross section along a plane passing through the center of the dimple 64 and the center of the golf ball 62. The dimple 64 has a curved surface. The diameter Di of the dimple 64 is preferably equal to or greater than 2.0 mm but equal to or less than 6.0 mm. The diameter Di is more preferably equal to or greater than 2.50 mm and particularly preferably equal to or greater than 3.0 mm. The diameter Di is more preferably equal to or less than 5.5 mm and particularly preferably equal to or less than 5.0 mm.

As shown in FIG. 9, a cross-sectional shape of the dimple 64 is a wave-like curve. The wave-like curve extends from one edge Ed to another edge Ed. The wave-like curve has two first curves 66, two second curves 68, two third curves 70, two fourth curves 72, and one fifth curve 74. Each first curve 66 is upwardly convex. Each second curve 68 is downwardly convex. Each third curve 70 is upwardly convex. Each fourth curve 72 is downwardly convex. The fifth curve 74 is upwardly convex. Each first curve 66 is connected to a land at an edge Ed. Each second curve 68 is connected to the first curve 66 at a first inflexion point 76. Each third curve 70 is connected to the second curve 68 at a second inflexion point 78. Each fourth curve 72 is connected to the third curve 70 at a third inflexion point 80. The fifth curve 74 is connected to the fourth curves 72 at fourth inflexion points 82. In the wave-like curve, a plurality of the upwardly convex curves 66, 70, and 74 and a plurality of the downwardly convex curves 68 and 72 are alternately arranged.

Figure 10:
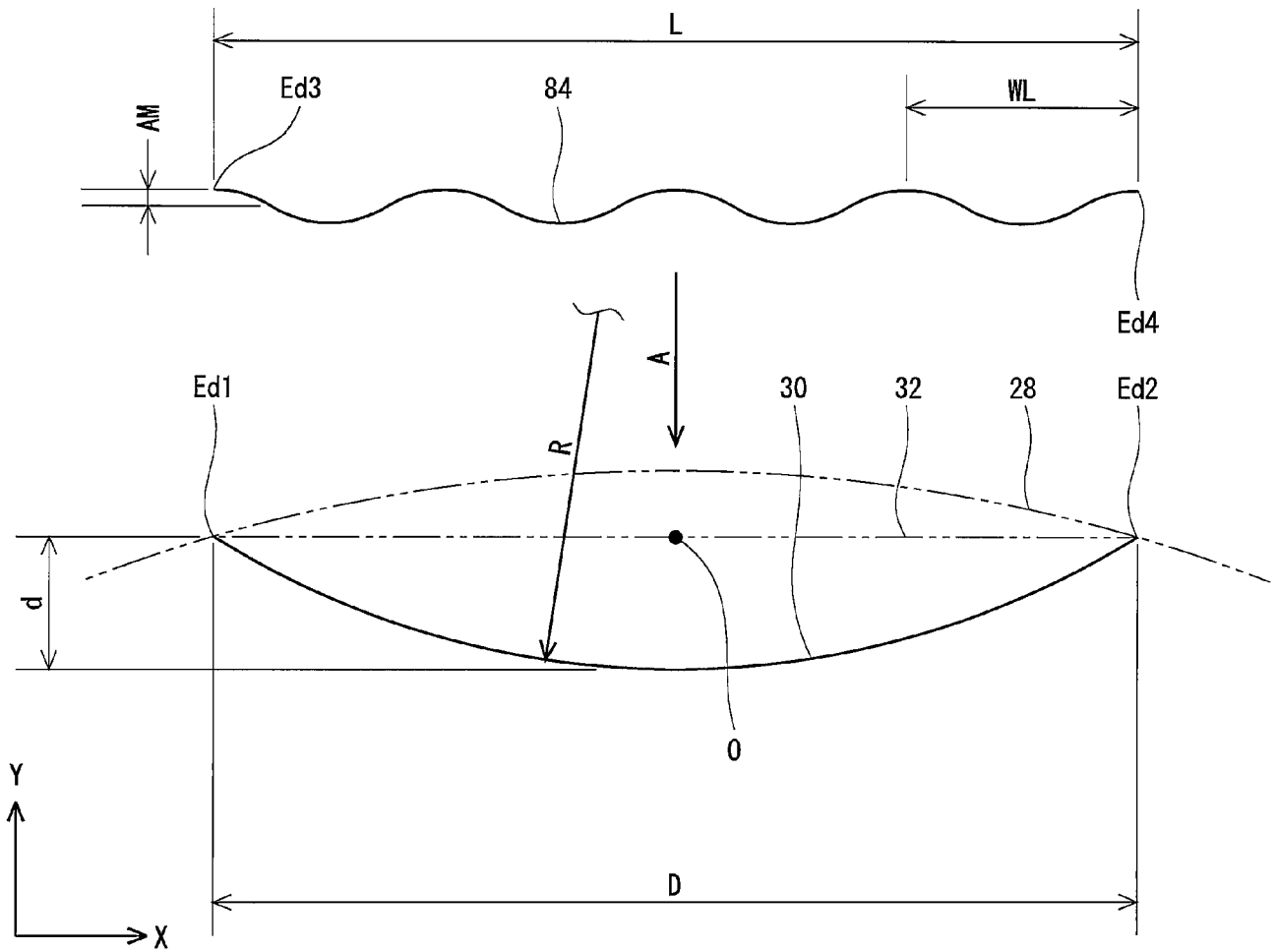
FIG. 10 is a view for illustrating a method for designing the dimple in FIG. 9.

In a method for designing the dimple 64, a circle 28 is assumed on an X-Y plane shown in FIG. 10. The radius of the circle 28 is the same as the radius of a phantom sphere of the golf ball 62 Further, a circular arc 30 (first curved line) is assumed on the X-Y plane. The circular arc 30 has one end Ed1 and another end Ed2 that are present on the circle 28. The circular arc 30 is downwardly convex. In FIG. 10, what is indicated by an arrow D is the length of a chord 32 corresponding to the circular arc 30. The coordinate of an origin O of the X-Y plane is (0, 0). The origin O is the midpoint of the chord 32. The y coordinate of a point on the circular arc 30 is represented by the above mathematical formula (1).

As shown in FIG. 10, a cosine curve 84 (second curved line) is assumed on the X-Y plane. The cosine curve 84 is bilaterally symmetrical. The cosine curve 84 has one end Ed3 and another end Ed4. In FIG. 10, what is indicated by an arrow L is the length of the cosine curve 84; what is indicated by an arrow WL is the wavelength of the cosine curve 84; and what is indicated by an arrow AM is the amplitude of the cosine curve 84. The length L of the cosine curve 84 is the same as the length D of the chord 32. The number of cycles of the cosine curve 84 is 4.0. The cosine curve 84 is moved in the direction indicated by an arrow A. As a result of the movement, the end Ed3 of the cosine curve 84 agrees with the end Ed1 of the circular arc 30, and the other end Ed4 of the cosine curve 84 agrees with the other end Ed2 of the circular arc 30.

Figure 11:
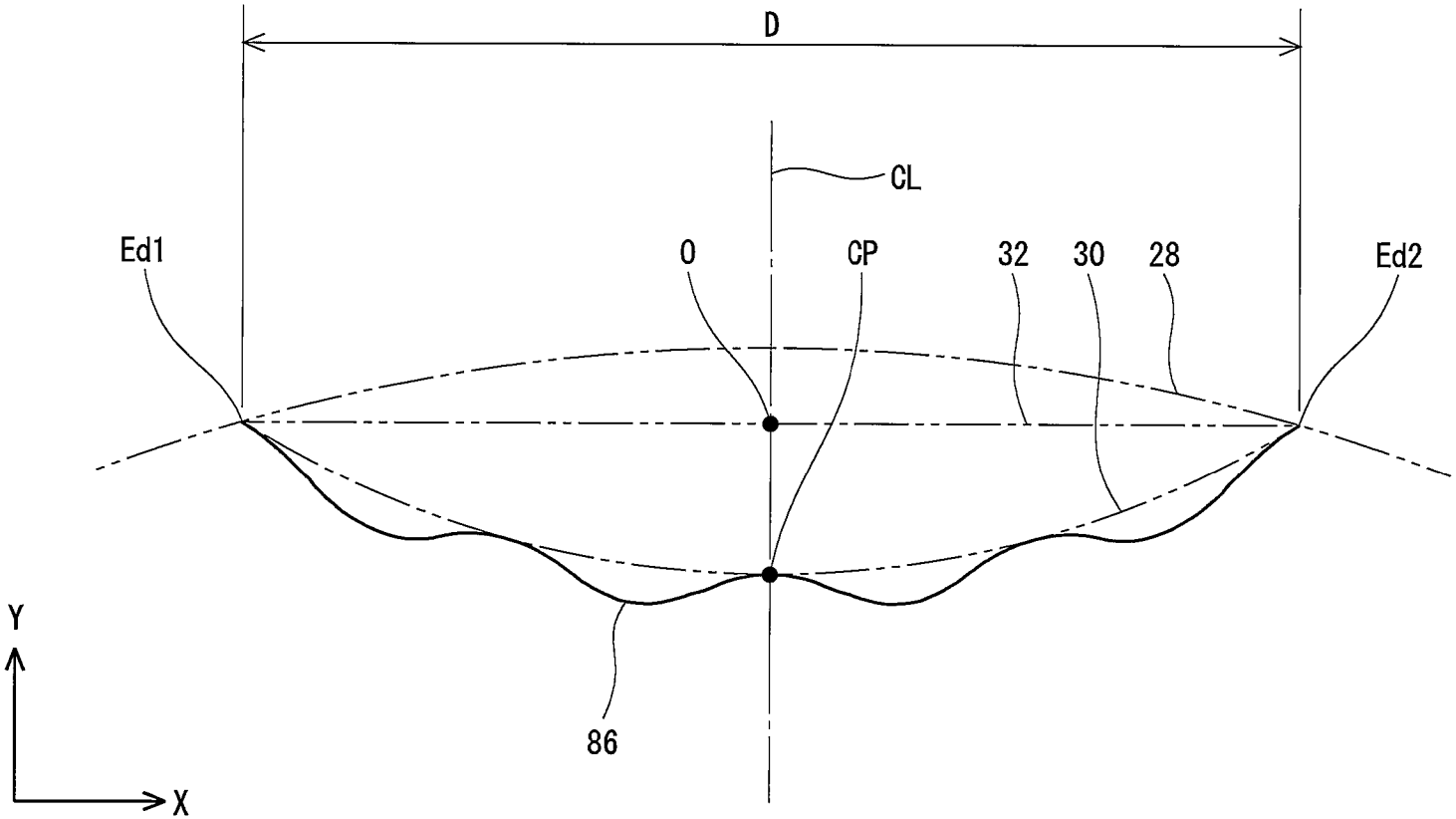
FIG. 11 is a view for illustrating the method for designing the dimple in FIG. 9.

The circular arc 30 and the cosine curve 84 are combined with each other. Specifically, to the y coordinate of each point on the circular arc 30, the y coordinate of a point, on the cosine curve 84, which has the same x coordinate as the x coordinate of this point, is added. As a result of the addition, a wave-like curve 86 is obtained. The wave-like curve 86 is shown in FIG. 11. The y coordinate of the wave-like curve 86 is represented by the following mathematical formula (4).

$$y = (R - d) - \sqrt{(R^2 - x^2)} + d \times Q \times \cos\left\{\left[\frac{\sin^{-1}\left(\frac{D}{2R}\right) + \sin^{-1}\left(\frac{x}{R}\right)}{\sin^{-1}\left(\frac{D}{2R}\right)}\right] \times \frac{S \times \pi}{180}\right\} \quad (4)$$

In the mathematical formula (4), Q denotes an amplitude adjustment coefficient, and S denotes an adjustment coefficient of the number of cycles. The coefficient Q is set as appropriate by taking into consideration a balance of the amplitude AM of the cosine curve 84 relative to the depth d of the circular arc 30. The coefficient S is set such that the desired number of cycles of the cosine curve 84 is achieved. When S is 360, the number of cycles is 2.0. When S is 540, the number of cycles is 3.0. When S is 720, the number of cycles is 4.0. When S is 900, the number of cycles is 5.0. When S is 1080, the number of cycles is 6.0. In the cosine curve 84 shown in FIG. 10, S is 720. Thus, the number of cycles of the cosine curve 84 is 4.0.

In FIG. 11, what is indicated by a reference sign CL is a straight line passing through the central point CP of the circular arc 30 and the origin O. The wave-like curve 86 is rotated 180 degrees about the straight line CL. On the basis of a trajectory through which the wave-like curve 86 passes by the rotation, a three-dimensional shape is obtained. The dimple 64 shown in FIG. 9 has this three-dimensional shape. The diameter Di of the dimple 64 is the same as the length D of the chord 32.

In the golf ball 62 as well, the wave-like curve 86 can cause local turbulence of air inside the dimple 64. The wave-like curve 86 is inferred to contribute to backward shift of separation points. The wave-like curve 86 is also inferred to contribute to re-contact of separated eddies. The golf ball 62 has excellent flight performance.

The number of cycles of the wave-like curve 86 obtained by combining the circular arc 30 and the cosine curve 84, is the same as the number of cycles of the cosine curve 84. As described above, the number of cycles of the cosine curve 84 shown in FIG. 10 is 4.0. Thus, the number of cycles of the wave-like curve 86 shown in FIG. 11 is 4.0. In light of flight performance, the number of cycles of the wave-like curve 86 is preferably equal to or greater than 2.0 but equal to or less than 6.0.

By the wave-like curve 86 symmetrical about the straight line CL being rotated, the dimple 64 can be formed so as not to have directional properties. The dimple 64 that does not have directional properties has excellent aerodynamic symmetry. In light of aerodynamic symmetry, the number of cycles of the wave-like curve 86 obtained by combining the circular arc 30 and the cosine curve 84, is preferably n (n is a natural number). Examples of the preferable number of cycles include 2.0, 3.0, 4.0, 5.0 and 6.0. 3.0, 4.0 and 5.0 are more preferred, and 4.0 is particularly preferred.

In light of flight performance, the ratio of the amplitude AM to the depth d of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly preferably equal to or less than 20%.

In light of flight performance, the ratio (WL/D) of the wavelength WL of the cosine curve 84 to the length D of the chord 32 is preferably equal to or greater than (1/6) but equal to or less than (1/2). The ratio (WL/D) is more preferably equal to or greater than (1/5). The ratio (WL/D) is more preferably equal to or less than (1/3). The ratio (WL/D) is particularly preferably (1/4).

The golf ball 62 may have: dimples 64 each having a curved surface whose cross-sectional shape is the wave-like curve 86; and other dimples 64. The ratio (N1/N) of the number N1 of the dimples 64 each having a curved surface whose cross-sectional shape is the wave-like curve 86, to the total number N of the dimples 64, is preferably equal to or greater than 0.3, more preferably equal to or greater than 0.5, and particularly preferably equal to or greater than 0.7. Ideally, the ratio (N1/N) is 1.0.

The depth d of the circular arc 30, the occupation ratio, and the total volume of the dimples, of the golf ball 62 are the same as those of the golf ball 2 shown in FIGS. 1 to 6.

In the golf ball 62, the y coordinate of the cosine curve 84 is added to the y coordinate of the circular arc 30. The y coordinate of the cosine curve 84 may be subtracted from the y coordinate of the circular arc 30.

EXAMPLES

Example 1

A rubber composition was obtained by kneading 100 parts by weight of a polybutadiene (trade name "BR-730", available from JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold including upper and lower mold halves each having a hemispherical cavity, and heated at 170° C. for 18 minutes to obtain a core with a diameter of 39.7 mm. On the other hand, a resin composition was obtained by kneading 50 parts by weight of an ionomer resin (trade name "Himilan 1605", available from Du Pont-MITSUI POLYCHEMICALS Co., LTD.), 50 parts by weight of another ionomer resin (trade name "Himilan 1706", available from Du Pont-MITSUI POLYCHEMICALS Co., LTD.), and 3 parts by weight of titanium dioxide. The above core was placed into a final mold having numerous pimples on its inside face, followed by injection of the above resin composition around the core by injection molding, to form a cover with a thickness of 1.5 mm. Numerous dimples having a shape that was the inverted shape of the pimples were formed on the cover. A clear paint including a two-component curing type polyurethane as a base material was applied to this cover to obtain a golf ball of Example 1 with a diameter of 42.7 mm and a weight of about 45.4 g. The golf ball has a PGA compression of about 85. The total volume of the dimples of the golf ball is 320 $mm^3$. The golf ball has a dimple pattern shown in FIGS. 2 and 3. The golf ball has dimples A, B and C. Each of the dimples A, B and C has the cross-sectional shape shown in FIG. 4.

Example 2

A golf ball of Example 2 was obtained in a similar manner as Example 1, except the final mold was changed. The golf ball has the dimple pattern shown in FIGS. 2 and 3. The golf ball has dimples A, B and C. Each of the dimples A, B and C has the cross-sectional shape shown in FIG. 9.

Comparative Example 1

A golf ball of Comparative Example 1 was obtained in a similar manner as Example 1, except the final mold was changed. The golf ball has the dimple pattern shown in FIGS. 2 and 3. The golf ball has dimples A, B and C. A cross-sectional shape of each of the dimples A, B and C is a circular arc.

[Flight Distance Test]

A driver with a titanium head (Trade name "XXIO", available from SRI SPORTS, Ltd., shaft hardness: X, loft angle:) 9° was attached to a swing machine available from Golf Laboratories, Inc. A golf ball was hit under the conditions of: a head speed of 49 m/sec; a launch angle of about 11°; and a backspin rotation rate of about 3000 rpm, and the distance from the launch point to the stop point was measured. At the test, the weather was almost windless. The measurement was done 10 times for PH rotation, and the measurement was done 10 times for POP rotation. The average values of the results are shown in the following Table 1.

TABLE 1

Results of Evaluation

| | | Example 1 | Example 2 | Comparative Example 1 |
|---|---|---|---|---|
| Dimple A | Diameter (mm) | 4.46 | 4.46 | 4.46 |
| | Cross-sectional shape | FIG. 4 | FIG. 9 | Circular arc |
| | Number | 112 | 112 | 112 |
| Dimple B | Diameter (mm) | 4.36 | 4.36 | 4.36 |
| | Cross-sectional shape | FIG. 4 | FIG. 9 | Circular arc |
| | Number | 100 | 100 | 100 |
| Dimple C | Diameter (mm) | 3.90 | 3.90 | 3.90 |
| | Cross-sectional shape | FIG. 4 | FIG. 9 | Circular arc |
| | Number | 120 | 120 | 120 |
| Flight distance (yard) | POP | 275 | 275 | 274 |
| | PH | 275 | 277 | 275 |

As shown in Table 1, the golf balls of Examples have excellent flight performance. From the results of evaluation, advantages of the present invention are clear.

The above dimples are applicable to a one-piece golf ball, a multi-piece golf ball, and a thread-wound golf ball, in addition to a two-piece golf ball. The above description is merely for illustrative examples, and various modifications can be made without departing from the principles of the present invention.

What is claimed is:

1. A golf ball having a large number of dimples on a surface thereof, wherein each dimple has a curved surface, a cross-sectional shape of the curved surface is a wave-like curve in which a plurality of upwardly convex portions and a plurality of downwardly convex portions are alternately arranged, the dimple is formed by rotating the wave-like curve around a straight line, and the wave-like curve is symmetrical about the straight line, and the wave-like curve is obtained by a sine curve and a circular arc being combined with each other.

2. The golf ball according to claim 1, wherein the number of cycles of the wave-like curve is equal to or greater than 1.5 but equal to or less than 5.5.

3. A golf ball having a large number of dimples on a surface thereof, wherein each dimple has a curved surface, a cross-sectional shape of the curved surface is a wave-like curve in which a plurality of upwardly convex portions and a plurality of downwardly convex portions are alternately arranged, the dimple is formed by rotating the wave-like curve around a straight line, and the wave-like curve is symmetrical about the straight line, and the wave-like curve is obtained by a cosine curve and a circular arc being combined with each other.

4. The golf ball according to claim 3, wherein the number of cycles of the wave-like curve is equal to or greater than 2.0 but equal to or less than 6.0.

* * * * *